US010829358B2

(12) United States Patent
Alberini et al.

(10) Patent No.: US 10,829,358 B2
(45) Date of Patent: Nov. 10, 2020

(54) DEVICE FOR THE MIXING OF FLUIDS

(71) Applicant: Roberto Marchetti, Modena (IT)

(72) Inventors: Viliam Alberini, Reggio Emilia (IT); Stefano Rolli, Reggio Emilia (IT)

(73) Assignee: Roberto Marchetti, Modena (IT)

( * ) Notice: Subject to any disclaimer, the term of this patent is extended or adjusted under 35 U.S.C. 154(b) by 358 days.

(21) Appl. No.: 15/751,070

(22) PCT Filed: Aug. 3, 2016

(86) PCT No.: PCT/IB2016/054691
§ 371 (c)(1),
(2) Date: Feb. 7, 2018

(87) PCT Pub. No.: WO2017/025866
PCT Pub. Date: Feb. 16, 2017

(65) Prior Publication Data

US 2018/0237280 A1 Aug. 23, 2018

(30) Foreign Application Priority Data

Aug. 7, 2015 (IT) ..... UB2015A003021

(51) Int. Cl.
*B67D 1/12* (2006.01)
*B67D 1/00* (2006.01)

(52) U.S. Cl.
CPC ..... *B67D 1/0036* (2013.01); *B67D 1/0085* (2013.01); *B67D 1/1293* (2013.01); *B67D 1/1295* (2013.01); *B67D 1/0044* (2013.01)

(58) Field of Classification Search
CPC ..... A47J 31/40; A47J 31/402; A47J 31/401; Y10T 137/87652; Y10T 137/8766;
(Continued)

(56) References Cited

U.S. PATENT DOCUMENTS

| | | | |
|---|---|---|---|
| 5,868,279 | A | 2/1999 | Powell |
| 6,450,369 | B1 | 9/2002 | Heyes |
| 2004/0084475 | A1 | 5/2004 | Bethuy et al. |

FOREIGN PATENT DOCUMENTS

| | | | |
|---|---|---|---|
| WO | 00/47058 | A1 | 8/2000 |
| WO | 2014/036098 | A1 | 3/2014 |

OTHER PUBLICATIONS

International Search Authority/EPO, International Search Report dated Nov. 4, 2016 in International Patent Application No. PCT/IB2016/054691, 3 pages.

(Continued)

*Primary Examiner* — Christopher J Besler
(74) *Attorney, Agent, or Firm* — Masuvalley & Partners

(57) ABSTRACT

The device (1) for the mixing of fluids comprises:—a first supply line (3) of a first fluid along which first valve means (4) are arranged, there being provided first control means (5) able to command the opening/closure of the first valve means (4); —at least a second supply line (6) of a second fluid along which second valve means (7) are arranged, there being provided second control means (8) able to command the opening/closure of the second valve means (7); —driving means (20) of the control means (5, 8) which comprise generation means (21, 22) of an impulsive driving signal (23) by pulses able to open the first valve means (4) and/or the second valve means (7) for an impulsive opening time (T-on) and to close the first valve means (4) and/or the second valve means (7) for an impulsive closure time (T-off), wherein the ratio between the impulsive opening time (T-on) and the impulsive closure time (T-off) for each pulse is constant and the pulses have a variable repetition frequency.

9 Claims, 6 Drawing Sheets

(58) Field of Classification Search
CPC ..... Y10T 137/87668; Y10T 137/87676; Y10T 137/876484; Y10T 137/87708
USPC ..... 99/323.2, 323.3; 222/145.5, 145.6, 145.7
See application file for complete search history.

(56) References Cited

OTHER PUBLICATIONS

International Search Authority/EPO, Written Opinion dated Nov. 4, 2016 in International Patent Application No. PCT/IB2016/054691, 5 pages.

DEVICE FOR THE MIXING OF FLUIDS

RELATED APPLICATIONS

The present invention is the U.S. National Phase of, and claims priority to, International Patent Application No. PCT/IB2016/054691 filed Aug. 3, 2016, which claims priority to Italian Patent Application Number UB2015A003021 filed Aug. 7, 2015; all of which are incorporated herein by reference in their entireties.

TECHNICAL FIELD

The present invention relates to a device for the mixing of fluids.

BACKGROUND ART

To date several types of device are known for the mixing of fluids, e.g., used to prepare drinks, where syrup or juice concentrate has to be mixed with a diluent, e.g., water, in order to obtain the desired drink.

These devices generally have a first supply line of a first fluid, e.g., water, along which are arranged first valve means adapted to control the flow rate of the first fluid itself, a second supply line of a second fluid, e.g., syrup or juice, along which are arranged second valve means adapted to control the flow rate of the second fluid itself, and mixing means for mixing the two fluids.

In order to obtain a drink flavor which is as reproducible as possible over time, the ratio between the dispensed fluids must be maintained substantially constant.

Some devices for the mixing of fluids are known from U.S. Pat. No. 5,868,279, US 2004/0084475 and U.S. Pat. No. 6,450,369, to name just a few.

In particular, U.S. Pat. No. 5,868,279 provides that along each of the supply lines be arranged relative normally-open valves and that downstream of these a flow meter be present adapted to send a signal to relative control means programmed to close the valves when the detected flow rate exceeds a predefined value.

Once the desired ratio between the fluids has been found to have been complied with, the control means reopen the previously closed valves.

The device described by U.S. Pat. No. 5,868,279 then performs a discrete type of control of the flow rate of the fluids, i.e., the moment the flow rate of one of the two fluids reaches the relative reference value, its dispensing is interrupted while that of the other fluid is kept active until the ratio between them has reached the required value.

The flow rate of the fluids is therefore adjusted by acting on the corresponding valves, closing them.

US 2004/0084475 describes a system for dispensing drinks in which a measurement is taken of the flow rate of the syrup, by means of a pressure sensor and a temperature sensor, and of the flow rate of the water, by means of a flow rate sensor, the signals of which are sent to a control device adapted to operate the relative valves in order to obtain the required ratio between the flow rates of the dispensed fluids.

In particular, the control device performs a modulation of the valves of the Pulse Width Modulation type (PWM) which varies the current flowing inside the valve coils and changes the magnetic field and the position of the valve shutter according to the flow rates detected and the preset ratio.

U.S. Pat. No. 6,450,369 describes a device for dispensing drinks which provides for a single piston placed between the fluid dispensing lines and the mixing means and adapted to regulate the dispensing of both fluids.

In particular, such device provides for the detection of the flow rate of both fluids and the feedback control of the water flow rate, by means of the aforementioned piston, according to the measured flow rate of the syrup in order to obtain a predefined ratio between them.

These known devices have some drawbacks.

They do not in fact allow a precise and rapid feedback control of the fluid flow rates. More in detail, the flow rate control performed by adjusting the opening time of the relative valves does not allow, also because of the response times of the relevant shutters, to carry out an effective feedback control of the flow rate of the fluids.

This limit of the devices of known type generally translates into low reproducibility over time of the flavor of the dispensed drinks, which can therefore affect appreciation by consumers.

Generally, the bigger the operating pressure and the viscosity of the dispensed fluids, the more evident this drawback is.

To this must be added the fact that the devices of known type have low if not zero capacity to regulate the flow rate of the two fluids and to maintain the desired mixing ratio with the variation in pressure and temperature of the fluids themselves.

DESCRIPTION OF THE INVENTION

The main aim of the present invention is to provide a device for the mixing of fluids which allows effectively performing the feedback control of the flow rate of the fluids.

Within this aim, one object of the present invention is to control, in a substantially continuous way, the flow rate of the dispensed fluids and their ratio.

Another object of the present invention is to reduce the head losses in the fluids during the crossing of the valve means, in order to curb the turbulences and loss of carbonation when the fluids are gassed.

Yet another object is to provide valve means that have quick and precise actuation and at the same time to avoid any sugar component contained in the syrup resulting over time in the formation of residues that hinder the shifting of the relative shutters.

A further object of the present invention is to provide a device for the mixing of fluids which allows:

- setting the flow rate of the fluids within a predetermined range;
- maintaining the flow rate unchanged at the different pressures imposed by the supply system positioned upstream of the device;
- maintaining and re-proposing the drink as fluid mixture even when the temperature changes.

Another object of the present invention is to provide a device for the mixing of fluids which allows overcoming the mentioned drawbacks of the prior art within the ambit of a simple, rational, easy, effective to use and affordable solution.

The above mentioned objects are achieved by the present device for the mixing of fluids according to claim 1.

BRIEF DESCRIPTION OF THE DRAWINGS

Other characteristics and advantages of the present invention will become better evident from the description of a preferred, but not exclusive, embodiment of a device for the mixing of fluids, illustrated by way of an indicative, but non-limiting, example in the accompanying drawings, wherein.

EMBODIMENTS OF THE INVENTION

Figure 1:
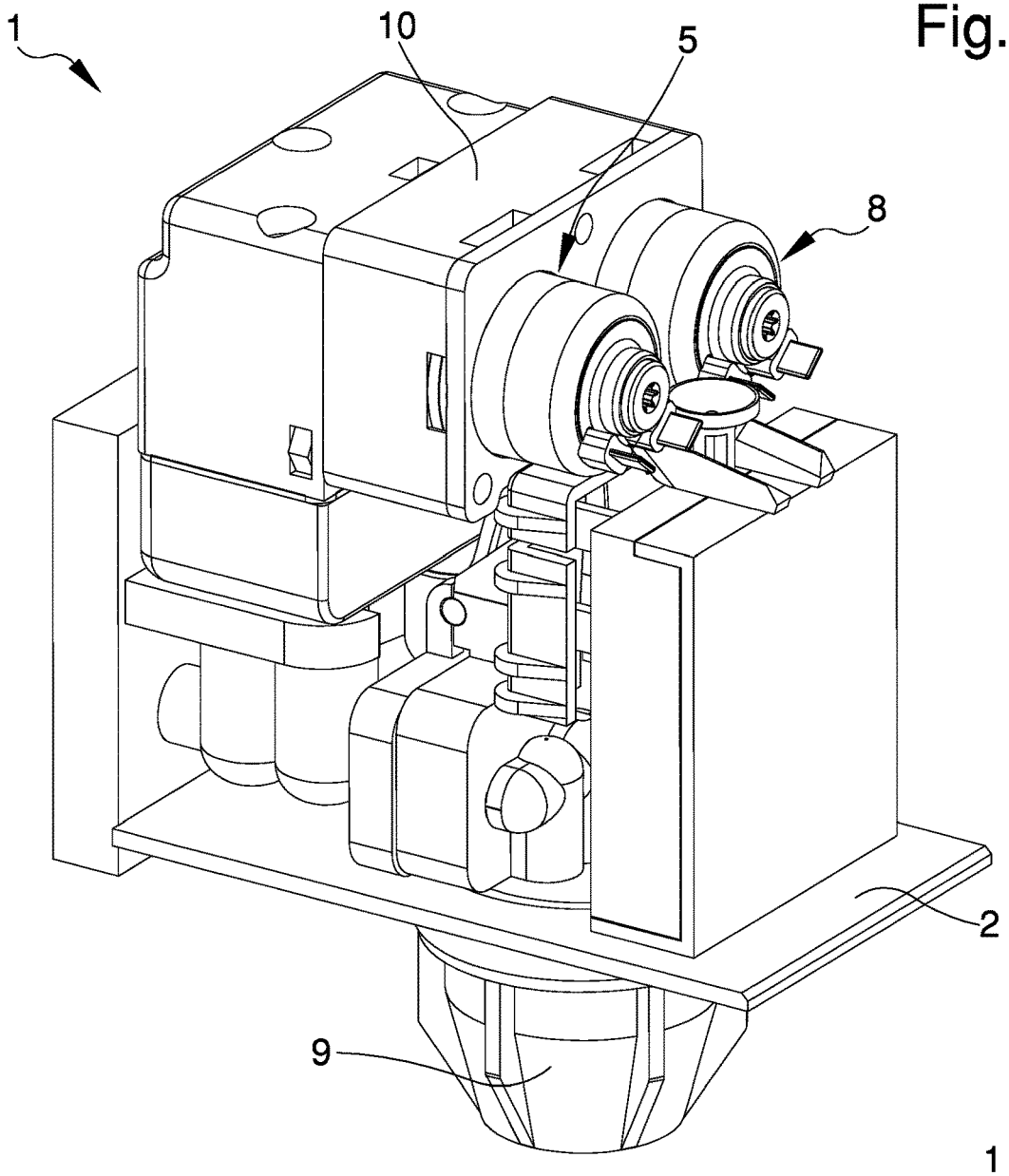
FIG. 1 is an axonometric view of the device according to the invention.
Figure 2:
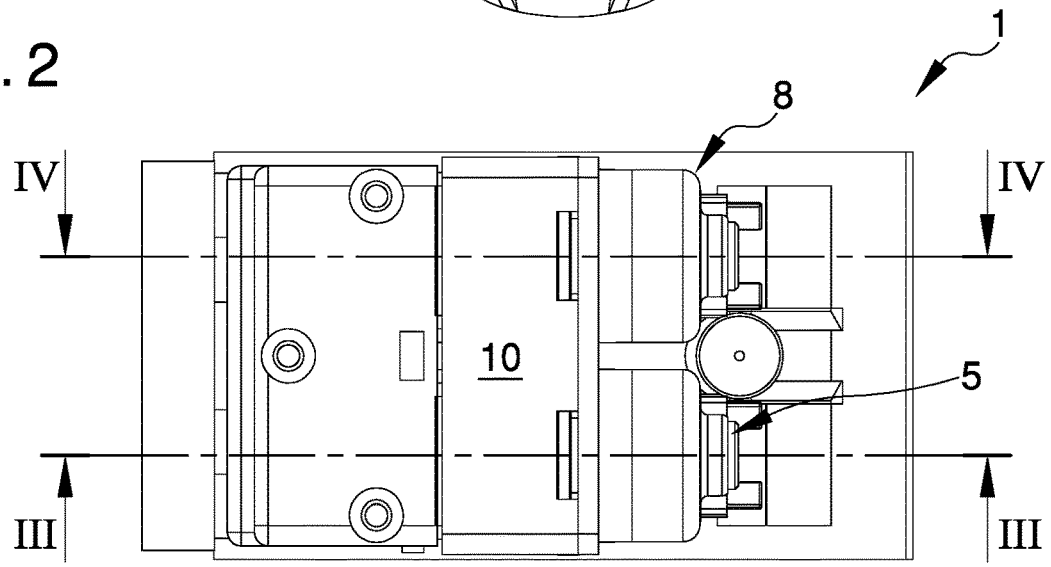
FIG. 2 is a top view of the device according to the invention.
Figure 4:
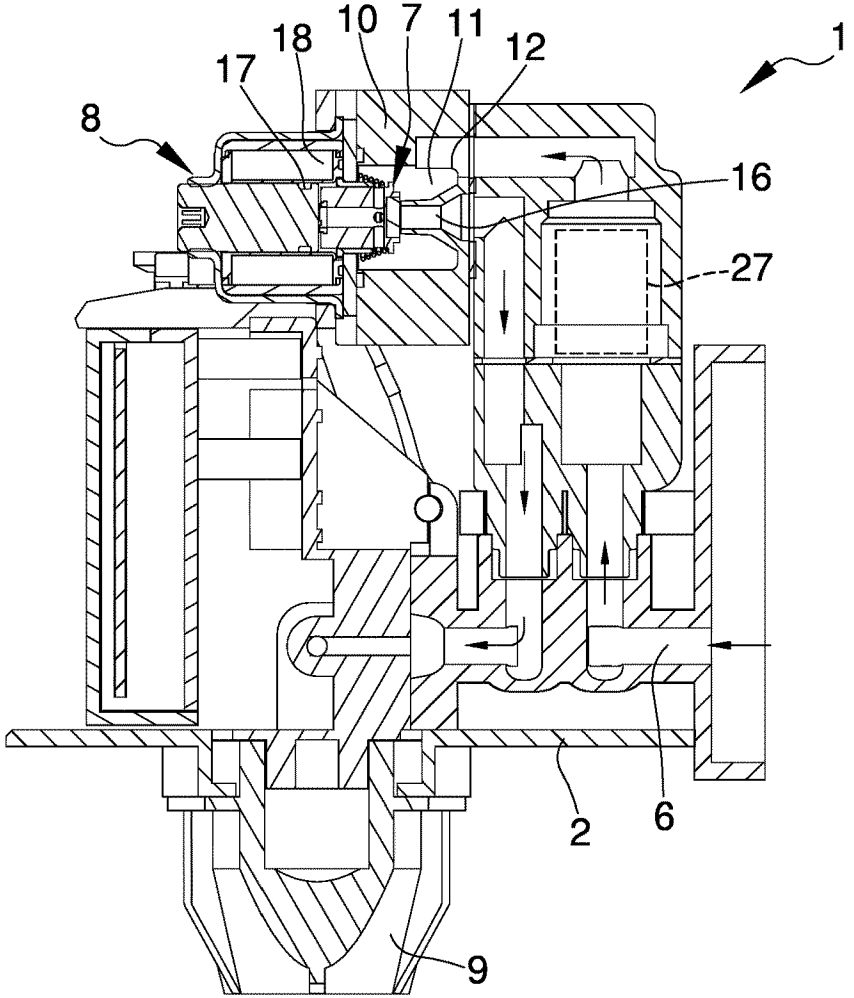
FIG. 4 is a sectional view along the plane IV-IV of FIG. 2.
Figure 3:
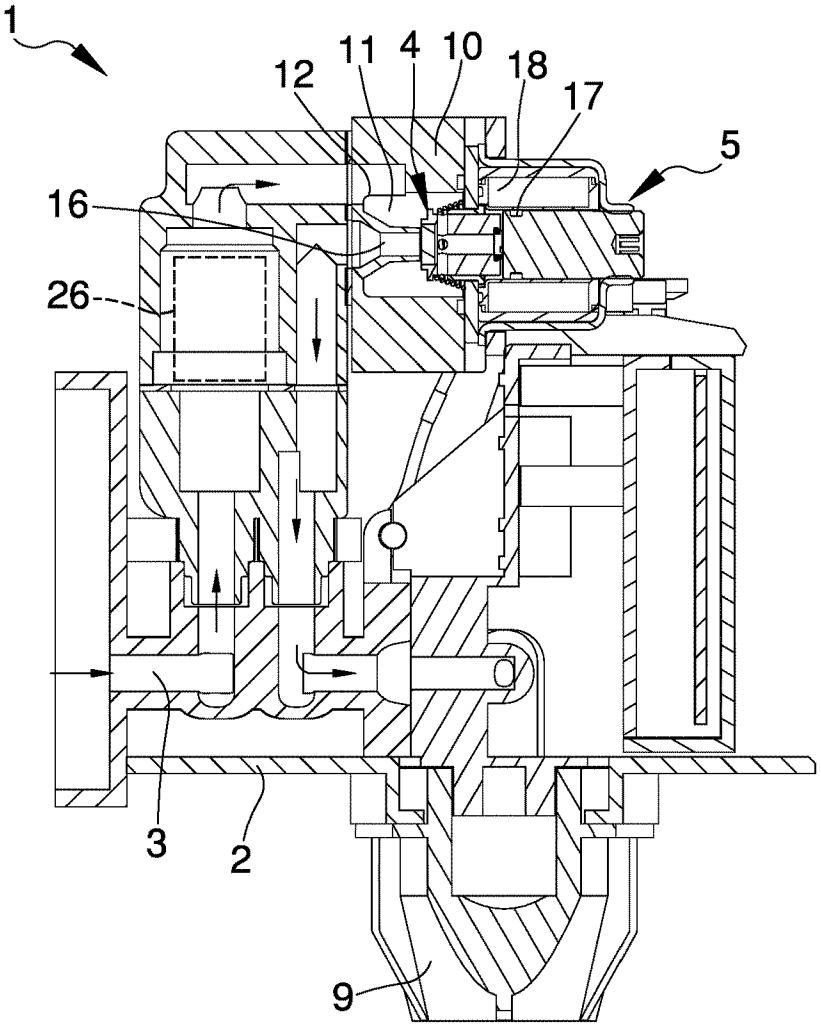
FIG. 3 is a sectional view along the plane III-III of FIG. 2.
Figure 5:
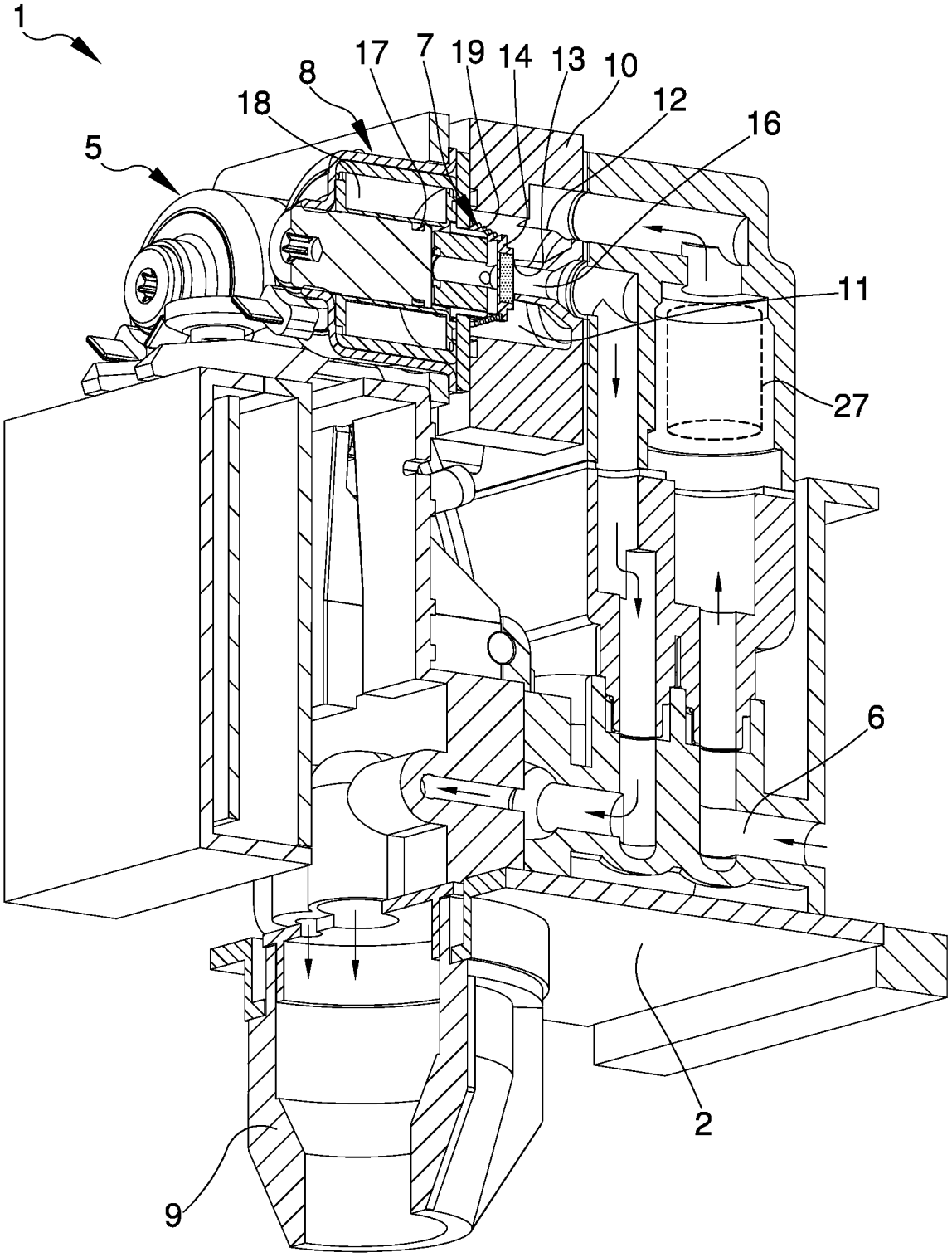
FIG. 5 is an axonometric view, from another angle and partially broken, of the device according to the invention.

With particular reference to such figures, globally indicated by reference numeral is 1 a device for the mixing of fluids, in particular for the production of drinks or the like.

The device 1 comprises a base frame 2 mountable, e.g., inside a drink dispensing machine not shown in detail in the illustrations because it is of known type.

On the base frame 2 is mounted a series of components assembled together so as to define:

- at least a first supply line 3 of a first fluid along which at least first valve means 4 are arranged, there being provided first control means 5 adapted to command the opening/closure of the first valve means 4 to regulate the flow rate of the first fluid itself;
- at least a second supply line 6 of a second fluid along which at least second valve means 7 are arranged, there being provided second control means 8 adapted to command the opening/closure of the second valve means 7 to regulate the flow rate of the second fluid itself; and
- mixing means 9 of the first fluid and of the second fluid communicating with the first supply line 3 and the second supply line 6. The mixing means 9 consist e.g. in a common outlet mouth where both the first supply line 3 and the second supply line 6 end up.

The first fluid consists, e.g., of water, if necessary with the addition of carbon dioxide.

The second fluid consists, e.g., of a syrup or a juice concentrate which, when mixed with water, form a drink.

At least one of the first valve means 4 and second valve means 7, preferably both, comprises a body 10 which defines a receiving chamber 11 of the relative fluid having at least one inlet port 12 and at least one outlet port 13.

Inside of the receiving chamber 11 is arranged at least one shutter 14 movable to put into communication with/isolate from each other the inlet port 12 and the outlet port 13.

The shutter 14 has an abutment surface with a substantially annular shape and adapted to rest on the body 10 at the outlet port 13 to obstruct the flow of the fluid.

Figure 6:
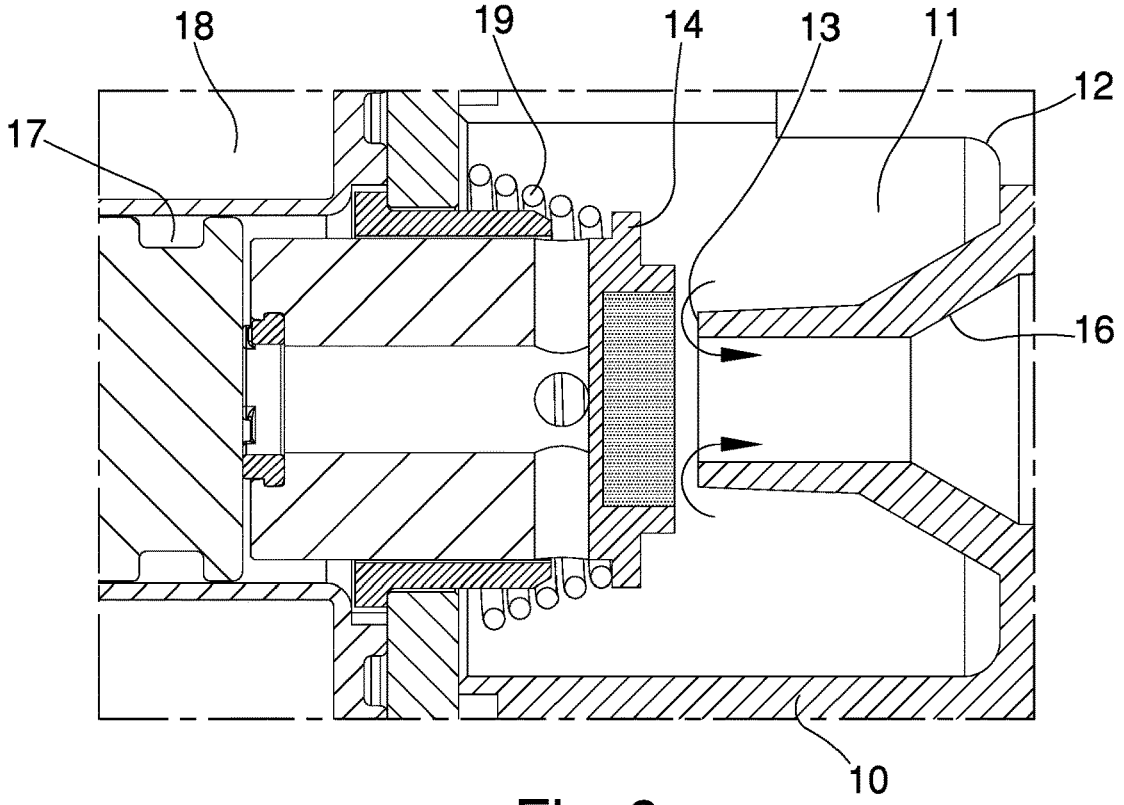
FIGS. 6 and 7 are sectional views, on an enlarged scale, illustrating a first embodiment of the valve means in the device according to the invention.
Figure 7:
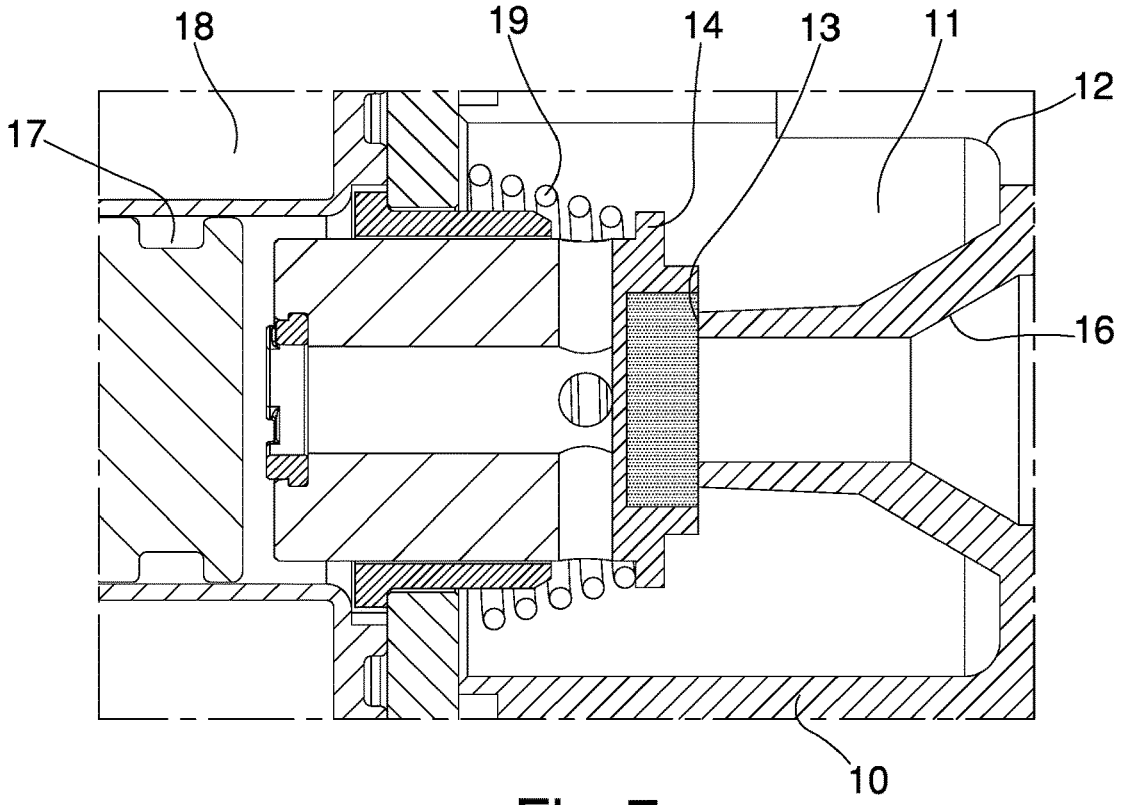

In a first embodiment of the valve means 4, 7 shown in detail in FIGS. 6 and 7, the outlet port 13 has a substantially circular shape and the abutment surface is adapted to rest on the body 10 at the peripheral edge of the outlet port itself.

Figure 9:
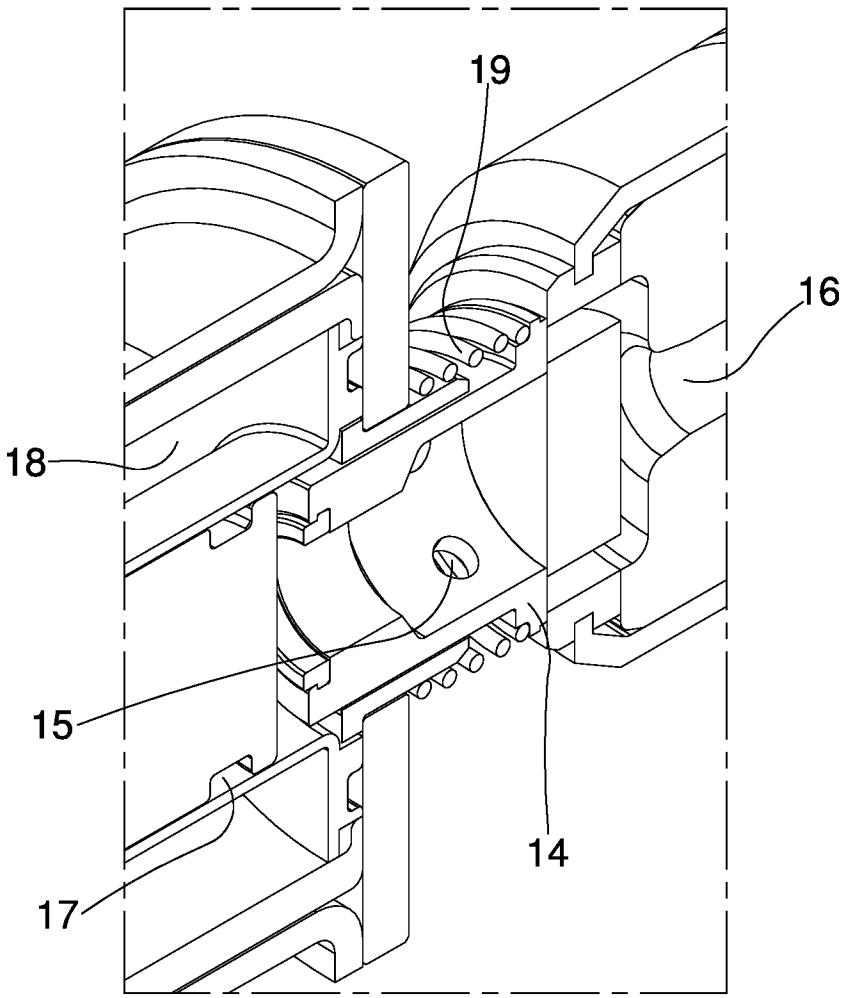
FIGS. 8 and 9 are axonometric views, on an enlarged scale and partially broken, illustrating a second embodiment of the valve means present in the device according to the invention.
Figure 8:
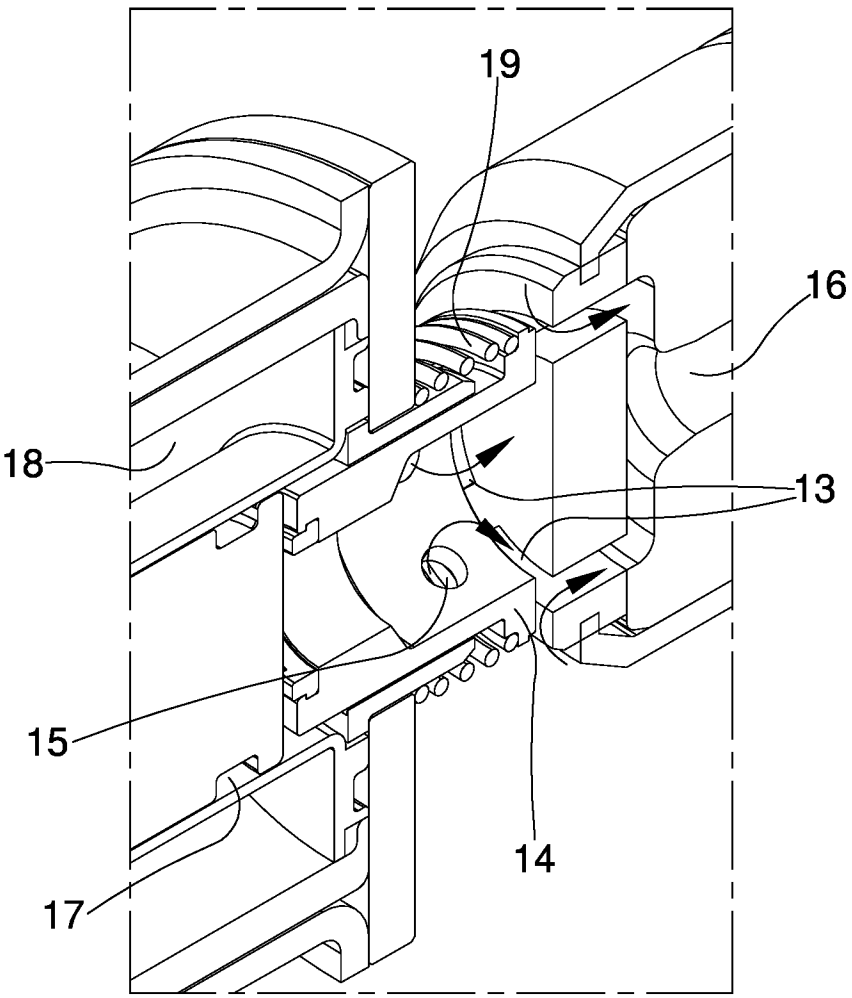
Figure 10:
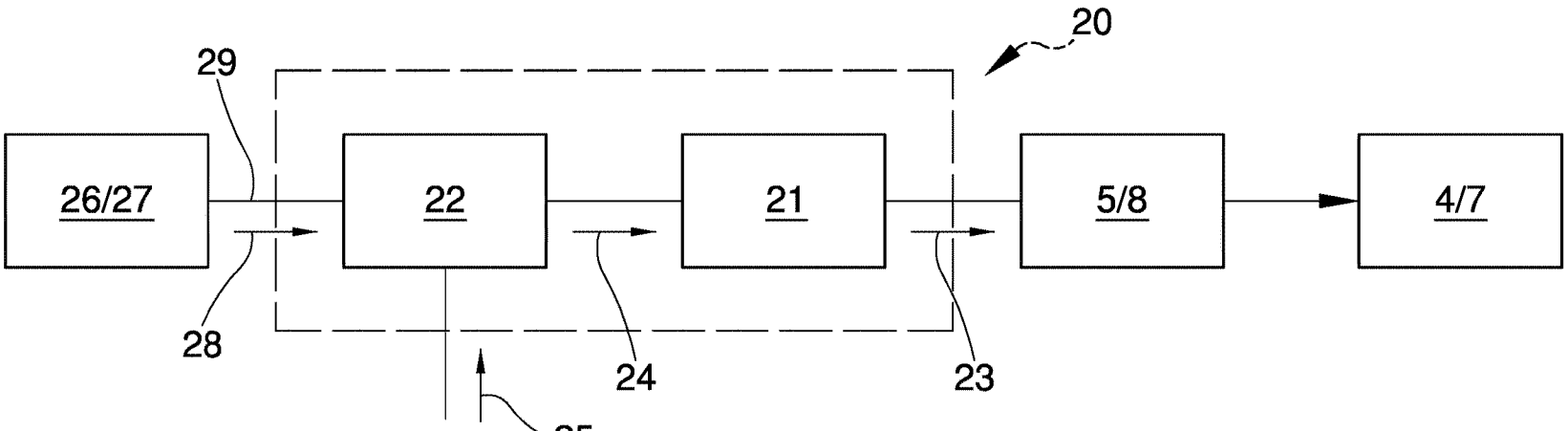
FIG. 10 is a diagram illustrating the control logic of the device according to the invention.

In a second embodiment of the valve means 4, 7 shown in detail in FIGS. 8 and 9, instead, the outlet port 13 has a substantially annular shape and is defined, e.g., by a series of curvilinear slots arranged precisely in a loop.

In this second embodiment, the abutment surface of the shutter 14 is adapted to abut at the outlet port itself and, usefully, the shutter 14 is cup-shaped, is internally hollow and has at least one opening 15 for the flow therethrough of the relative fluid; this way, the flow of the relative fluid is made easier through the valve means 4, 7 when the shutter 14 is moved away from the outlet port 13. Advantageously, the body 10 defines at least one outlet channel 16 for the fluid which extends from the outlet port 13 and which is substantially shaped as a Venturi tube.

At least one of the first valve means 4 and the second valve means 7, preferably both, comprises at least a sealing element 17 adapted to separate in a hydraulically-operated manner the relative control means 5, 8 from the relative receiving chamber 11, thus preventing the fluids from flowing out of the receiving chamber 11 and wetting the control means.

In this regard it is specified that the control means 5, 8 are of the electronic type and must therefore be kept dry.

In particular, at least one of the first control means 5 and the second control means 8, preferably both, comprises at least one command coil 18.

Thanks to the command coil 18, the control means 5, 8 are commandable between an active configuration, wherein they are able to generate a magnetic field to attract the shutter 14 towards the opening position, and a rest configuration, wherein they interrupt the magnetic field and comprise return means 19, of the type of a spring or the like, adapted to counteract the shift of the shutter 14 itself towards the relative opening position.

The device 1 comprises driving means 20 for driving at least one of the first control means 5 and the second control means 8 and adapted to maintain at least a predefined ratio between the flow rate of the first fluid and the flow rate of the second fluid along the relative supply lines 3, 6.

The driving means 20 comprise generation means 21, 22 of an impulsive driving signal 23 by pulses which are adapted to open the first valve means 4 and/or the second valve means 7 for an impulsive opening time T-on and to close the first valve means 4 and/or the second valve means 7 for an impulsive closure time T-off, wherein the ratio between the impulsive opening time T-on and the impulsive closure time T-off for each pulse is constant and the pulses have a variable repetition frequency.

At every opening and closure cycle of the valve means 4, 7, in practice, the duration of the impulsive opening time T-on and the duration of the impulsive closure time T-off may change but always in a proportional way.

In other words, if the impulsive opening time T-on changes, then the impulsive closure time T-off also changes proportionally.

Figure 11:
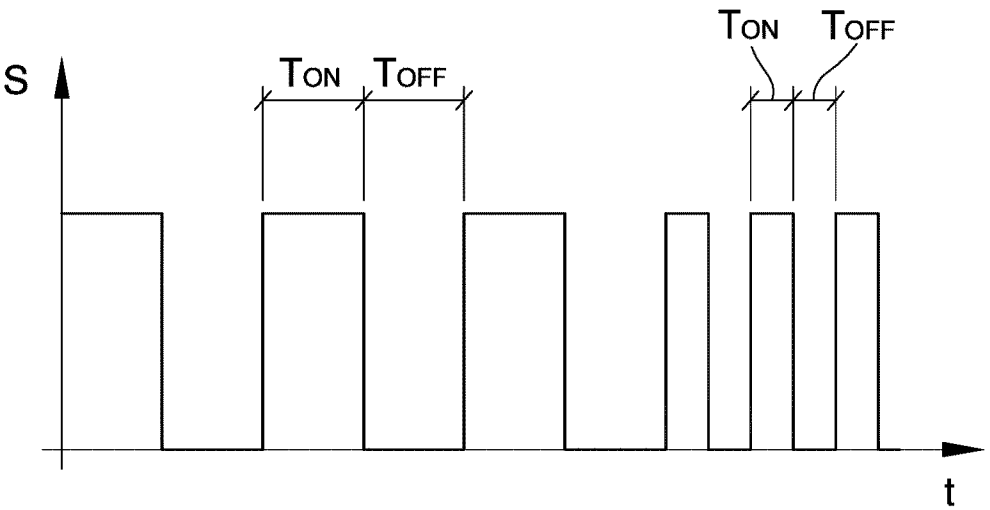
FIG. 11 is a graph illustrating a possible sequence of the opening and closure cycles of the valve means of the device according to the invention.

Such pattern is graphically shown in FIG. 11, wherein it can be seen that, in a first operating phase, the pulses are characterized by rather long impulsive opening times T-on and impulsive closure times T-off repeated with a rather low repetition frequency, while, in a second operating phase, the pulses are characterized by rather short impulsive opening times T-on and impulsive closure times T-off repeated with a rather low repetition frequency; both in the first operating phase and in the second operating phase, nevertheless, the T-on/T-off ratio is fixed and unchanged.

The impulsive driving signal 23 is usefully made up of a signal of the PFM (Pulse Frequency Modulation) type, in which in practice the duration of the pulses, i.e., precisely intended as T-on/T-off ratio, is fixed and the repetition frequency varies.

The PFM frequency is determined by the system essentially on the basis of the combined action of a feedback integral control error and a reference feed-forward control.

In particular, the generation means 21, 22 comprise at least a pulse (PFM) frequency modulation unit 21 adapted to receive at input a predetermined control signal 24 to be modulated and to return at output the impulsive driving signal 23.

The generation means 21, 22 also comprise at least a control circuit 22 connected upstream of the frequency modulation unit 21, adapted to receive at input at least a reference flow value 25, provided by a management unit, and adapted to generate at output the control signal 24.

The driving means 20 also comprise at least one flow rate sensor 26, 27 arranged along the first supply line 3 and/or the second supply line 6, respectively upstream of the first valve means 4 and/or of the second valve means 7, which is adapted to measure at least one flow value 28 corresponding to the flow rate of the fluids in the supply lines 3, 6.

The control circuit 22 comprises at least one feedback line 29 connected to the flow rate sensor 26, 27, which allows the control circuit 22 to receive at input not only the reference flow value 25 but also the flow value 28 measured by the flow rate sensor 26, 27.

The control circuit 22 compares the reference flow rate 25 and the flow value 28 measured by the flow rate sensor 26, 27, and calculates the control error as the difference between the two and, if necessary, integrates it by means of an integrator.

From the integral control error and from the reference flow value 25, which is nothing more than a feed-forward control, the control circuit 22 provides the control signal 24 to be modulated at output.

The control signal 24 is received by the frequency modulation unit 21 which returns at output the impulsive driving signal 23 having the pulse frequency PFM which depends proportionally on the magnitude of the control signal 24.

The impulsive driving signal 23 thus obtained commands the opening and the closure of the valve means 4, 7.

In this respect, it should be noticed that the command coil 18 of the control means 5, 8 is operatively connected to the output of the generation means 21, 22 and to at least one of the first and second valve means 4, 7.

The command coil 18 is also adapted to actuate at least one of the first and the second valve means 4, 7 at each pulse of the impulsive driving signal 23.

Advantageously, there are two command coils 18, one for the first control means 5 and one for the second control means 8.

Similarly, there are two flow rate sensors 26, 27, of which a first flow rate sensor 26 is arranged along the first supply line 3 and a second flow rate sensor 27 is arranged along the second supply line 6.

The flow rate sensors 26, 27 are preferably of the type without movement.

The invention claimed is:

1. A device (1) for the mixing of fluids comprising:

at least a first supply line (3) of a first fluid along which at least first valve means (4) are arranged, there being provided first control means (5) able to command an opening/closure of said first valve means (4) to regulate a flow rate of the first fluid itself;

at least a second supply line (6) of a second fluid along which at least second valve means (7) are arranged, there being provided second control means (8) able to command an opening/closure of said second valve means (7) to regulate a flow rate of the second fluid itself;

driving means (20) of at least one of said first and second control means (5, 8) able to maintain at least a predefined ratio between the flow rate of said first fluid and the flow rate of said second fluid;

mixing means (9) of said first and second fluid communicating with said first and said second supply line (3, 6);

wherein said driving means (20) comprise generation means (21, 22) of an impulsive driving signal (23) by pulses able to open said first valve means (4) and/or said second valve means (7) for an impulsive opening time (T-on) and to close said first valve means (4) and/or said second valve means (7) for an impulsive closure time (T-off), and wherein a ratio between said impulsive opening time (T-on) and said impulsive closure time (T-off) for each of said pulses is constant and said pulses have a variable repetition frequency.

2. A device (1) according to claim 1, wherein said impulsive driving signal (23) is made up of a signal of the PFM (Pulse Frequency Modulation) type.

3. A device (1) according to claim 1, wherein at least one of said first and second valve means (4, 7) comprises a body (10) which defines a receiving chamber (11) of the relative fluid having at least one inlet port (12) and at least one outlet port (13), and in that it comprises at least one shutter (14) movable to put into communication with each other/isolate said inlet port (12) and said outlet port (13).

4. A device (1) according to claim 3, wherein said shutter (14) has an abutment surface with a substantially annular shape and able to rest on said body (10) at said outlet port (13) to obstruct a flow of either the first or the second fluid.

5. A device (1) according to claim 4, wherein said outlet port (13) has a substantially circular shape and in that said abutment surface is able to rest on said body (10) at the peripheral edge of the outlet port itself (13).

6. A device (1) according to claim 4, wherein said outlet port (13) has a substantially annular shape, said abutment surface being able to abut at the outlet port itself (13), and in that said shutter (14) is internally hollow and has at least one opening (15) for the flow therethrough of a relative fluid.

7. A device (1) according to claim 3, wherein said body (10) defines at least one outlet channel (16) for either the first or the second fluid which extends from said outlet port (13) and which is substantially shaped as a Venturi tube.

8. A device (1) according to claim 3, wherein at least one of said first and second valve means (4, 7) comprises at least a sealing element (17) able to separate in a hydraulically-operated manner the relative control means (5, 8) from the relative receiving chamber (11).

9. A device (1) according to claim 3, wherein said control means (5, 8) may be commanded between an active configuration, wherein they are able to generate a magnetic field to attract said shutter (14) towards an opening position, and a rest configuration, wherein they interrupt said magnetic field and comprise return means (19) able to counteract the shift of the shutter itself (14) towards a relative opening position.

* * * * *